US005921037A

United States Patent [19]

Minter

[11] Patent Number: 5,921,037

[45] Date of Patent: Jul. 13, 1999

[54] FENESTRATION PRODUCT WITH UNITARY FRAME MEMBERS AND METHOD OF MANUFACTURE

[75] Inventor: Mearl J. Minter, Oskaloosa, Iowa

[73] Assignee: Pella Corporation, Pella, Iowa

[21] Appl. No.: 08/823,493

[22] Filed: Mar. 25, 1997

[51] Int. Cl.[6] ..... E06B 1/16

[52] U.S. Cl. ..... 52/204.5; 52/204.53; 52/204.7; 52/656.5; 52/656.9; 52/800.14

[58] Field of Search ..... 52/204.53, 204.597, 52/204.62, 204.7, 656.5, 656.6, 656.9, 800.14, 204.5

[56] References Cited

U.S. PATENT DOCUMENTS

| | | | |
|---|---|---|---|
| Re. 30,930 | 5/1982 | Trachtenburg et al. . | |
| 2,264,187 | 11/1941 | Owen | 52/656.5 X |
| 2,304,423 | 12/1942 | Schiller | 52/204.7 |
| 3,566,542 | 3/1971 | Gillen et al. | 52/656.5 X |
| 3,759,004 | 9/1973 | Kent . | |
| 3,868,805 | 3/1975 | Battersby . | |
| 3,935,351 | 1/1976 | Franz . | |
| 3,955,331 | 5/1976 | Williams . | |
| 3,957,406 | 5/1976 | Battersby . | |
| 3,992,769 | 11/1976 | Jackson . | |
| 4,138,807 | 2/1979 | Tractenburg et al. . | |
| 4,193,236 | 3/1980 | Mazzoni et al. . | |
| 4,259,135 | 3/1981 | Kulla . | |
| 4,277,294 | 7/1981 | Orcutt . | |
| 4,293,363 | 10/1981 | Wakabayashi et al. . | |
| 4,334,941 | 6/1982 | Neely, Jr. . | |
| 4,342,144 | 8/1982 | Doguchi . | |
| 4,463,540 | 8/1984 | Gordon . | |
| 4,525,966 | 7/1985 | Litchfield et al. . | |
| 4,615,159 | 10/1986 | Kessler . | |
| 4,669,241 | 6/1987 | Kelly . | |
| 4,822,649 | 4/1989 | Canaud et al. . | |
| 4,909,875 | 3/1990 | Canaud et al. . | |
| 4,951,927 | 8/1990 | Johnston et al. . | |
| 4,994,309 | 2/1991 | Reichert et al. . | |
| 4,999,147 | 3/1991 | Kojima et al. . | |
| 4,999,958 | 3/1991 | Harrison . | |
| 5,090,168 | 2/1992 | Fast et al. | 52/656.5 X |
| 5,120,485 | 6/1992 | Johnson . | |
| 5,137,770 | 8/1992 | Rothe et al. . | |
| 5,156,894 | 10/1992 | Hood et al. . | |
| 5,339,583 | 8/1994 | Hrdlicka et al. . | |
| 5,356,687 | 10/1994 | Suenaga et al. . | |
| 5,485,705 | 1/1996 | Guillemet | 52/656.9 |

FOREIGN PATENT DOCUMENTS

| | | | |
|---|---|---|---|
| 121291 | 4/1946 | Australia | 52/800.14 |

*Primary Examiner*—Christopher Kent
*Assistant Examiner*—Timothy B. Kang
*Attorney, Agent, or Firm*—Hovey, Williams, Timmons & Collins

[57] ABSTRACT

A fenestration apparatus such as a door or window includes a unitary frame having first and second walls defining a cavity that opens toward the inboard wall of the frame. The first wall includes ridges defining a trough for receiving a bead of sealant. The second wall includes a shelf and a ramp between the shelf and the cavity opening. During assembly, the edge of the pane engages the ramp and follows the contour thereof toward a seated position on the shelf and toward a seated position against the ridges and sealant bead. This avoids the squeezing out of any sealant onto exposed portions of the pane.

28 Claims, 3 Drawing Sheets

FENESTRATION PRODUCT WITH UNITARY FRAME MEMBERS AND METHOD OF MANUFACTURE

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention is concerned with the field of fenestration products. More particularly, the invention concerns a fenestration apparatus, such as a door or window, including a unitary frame having first and second walls defining a cavity that opens toward the inboard wall of the frame for receiving a pane.

2. Description of the Prior Art

In one prior art technique for assembling a fenestration product such as a door or window, the frame is configured in two parts—an interior section and an exterior section. A pane is seated in the interior section and then the exterior section is placed over the interior section to secure the pane therebetween. The exterior section usually includes a bead of sealant for adhering the pane thereto and for sealing against the weather.

The use of a frame presenting a unitary cross section would be desirable for efficiency of manufacture using extrusion techniques, for improving structural strength and for ease of assembly. Such has not been practical, however, because of the tendency for sealant to squeeze out onto the pane during the assembly process, requiring manual removal of the visible sealant.

SUMMARY OF THE INVENTION

The present invention solves the prior art problems discussed above and provides a distinct advance in the state of the art. In particular, the fenestration product hereof allows the use of frame members presenting a unitary cross section for increased efficiency of manufacture and assembly and improve structural integrity.

The preferred fenestration apparatus includes a plurality of frame members coupled in a surrounding relationship relative to a pane. Each preferred frame member includes first and second walls defining a pane-receiving cavity opening through the inboard wall of the member. The first wall includes a pane support surface preferably in the form of a pair of support ridges defining a sealant-receiving trough therebetween. The second wall includes a shelf spaced from the ridges by the thickness of the pane for supporting the pane therebetween, and includes a ramp positioned between the shelf and the cavity opening for providing a gradual narrowing of the cavity from the opening toward the shelf.

During assembly, the frame members and pane are shifted toward one another so that the pane edge initially engages the ramp. During continued shifting, the pane edge follows the contour of the ramp toward the shelf and toward the support ridges and sealant bead. During the shifting, the pane engages the sealant bead. Continued movement of the pane toward the shelf avoids the squeezing out of any of the sealant onto the visible surfaces of the pane. Other preferred aspects of the present invention are discussed further herein.

DETAILED DESCRIPTION OF THE PREFERRED EMBODIMENT

Figure 1:
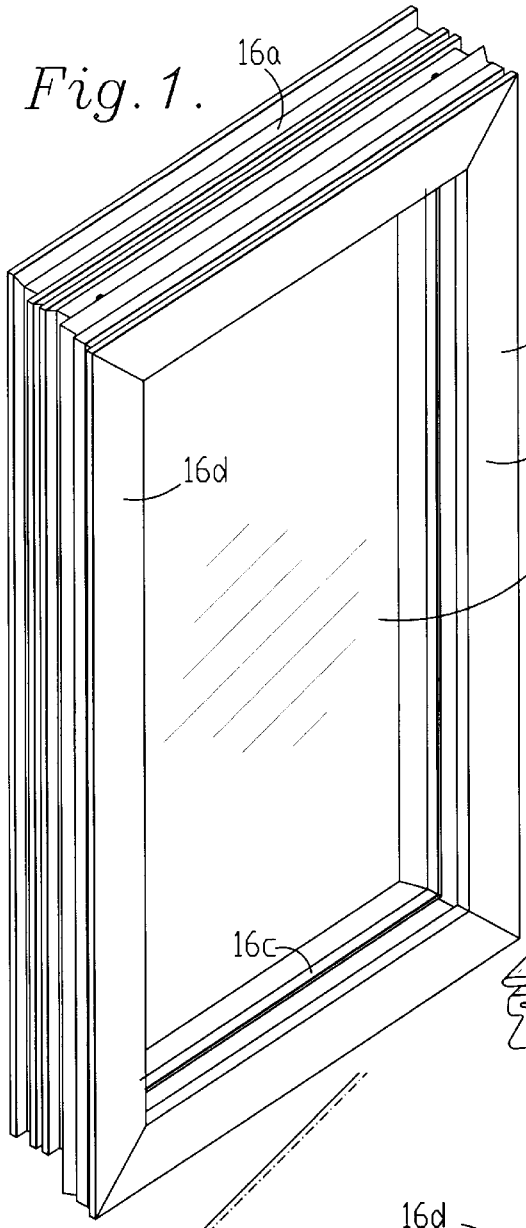
FIG. 1 is a perspective view of the preferred fenestration apparatus of the present invention.
Figure 7:
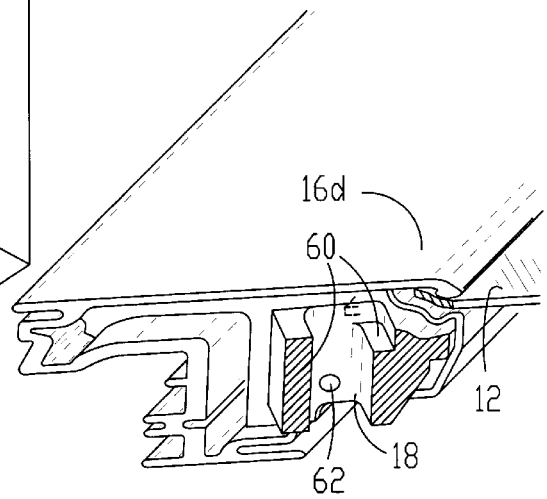
FIG. 7 is a partial sectional view taken along line 7—7 of FIG. 6.
Figure 6:
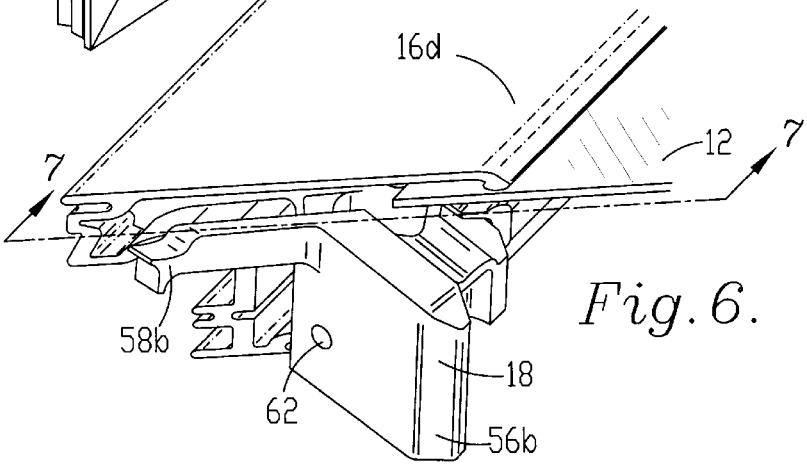
FIG. 6 is a partial perspective view of an end of a frame member of FIG. 1.

FIG. 1 illustrates preferred fenestration apparatus 10 in the form of a window and broadly includes pane 12 and frame or sash 14. As will be appreciated, pane 12 is preferably composed of glass and is clear, but could be composed of other materials including synthetic resins and could be shaded, translucent or even opaque.

Figure 2:
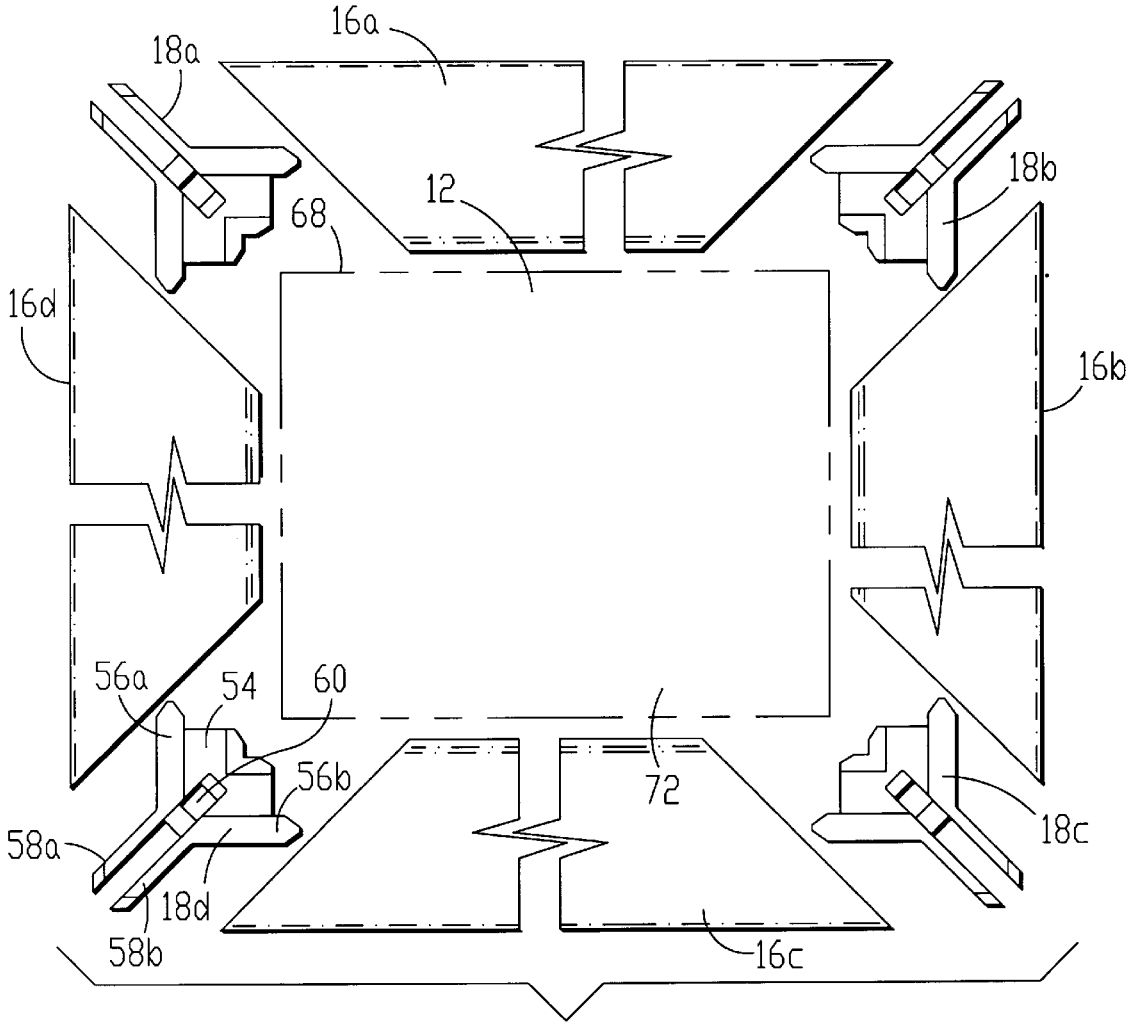
FIG. 2 is an exploded plan view of the apparatus of FIG. 1.
Figure 8:
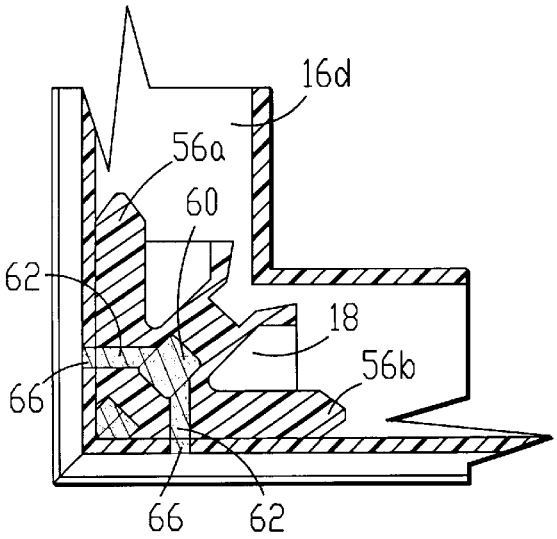
FIG. 8 is a partial sectional view taken along line 8—8 of FIG. 5.
Figure 9:
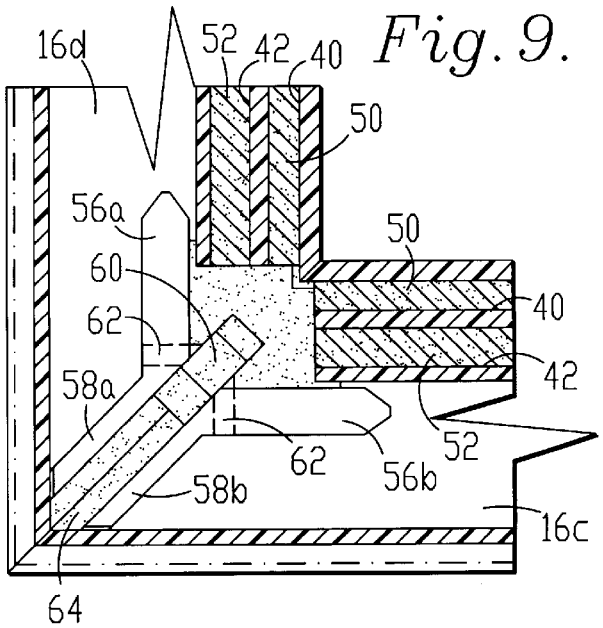
FIG. 9 is a partial sectional view taken along line 9—9 of FIG. 5.

As illustrated in FIG. 2, frame 14 includes frame members 16 individually designated as 16*a*, 16*b*, 16*c* and 16*d* and corner couplers 18 individually designated as 18*a*, 18*b*, 18*c* and 18*d*. Each frame member 16 presents opposed ends are mitered to mate with an adjacent frame member end in order to form the corners as illustrated in FIGS. 1, 8 and 9. Each frame member 16 is preferably extruded to form an integral, unitary body composed of pultrusion, synthetic resin material, composites or other material suitable for forming window frames.

Figure 3:
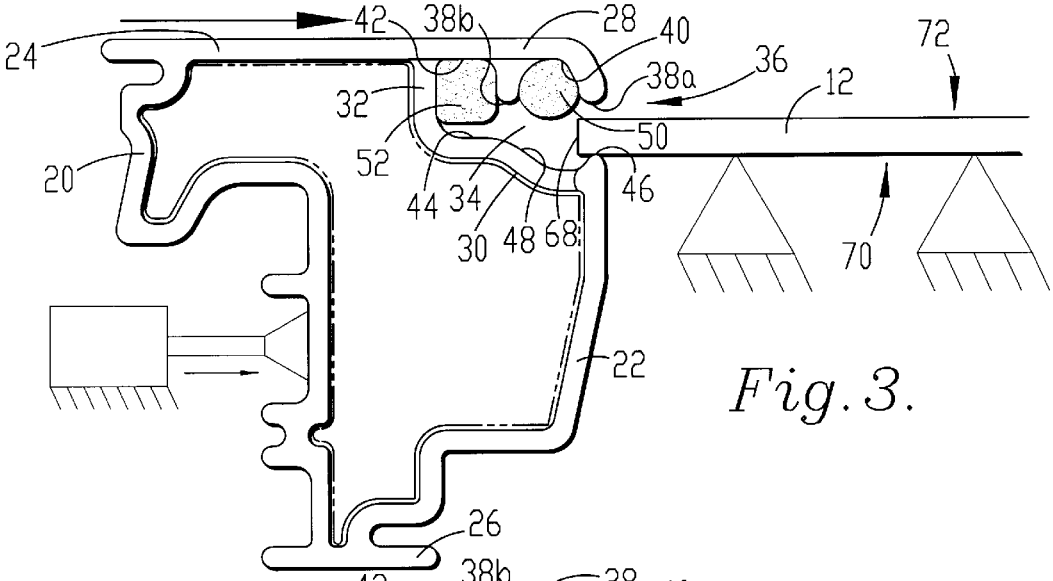
FIG. 3 is a sectional view of one of the frame members of FIG. 1 in relation to a pane illustrating a step in the manufacture of the preferred apparatus.
Figure 4:
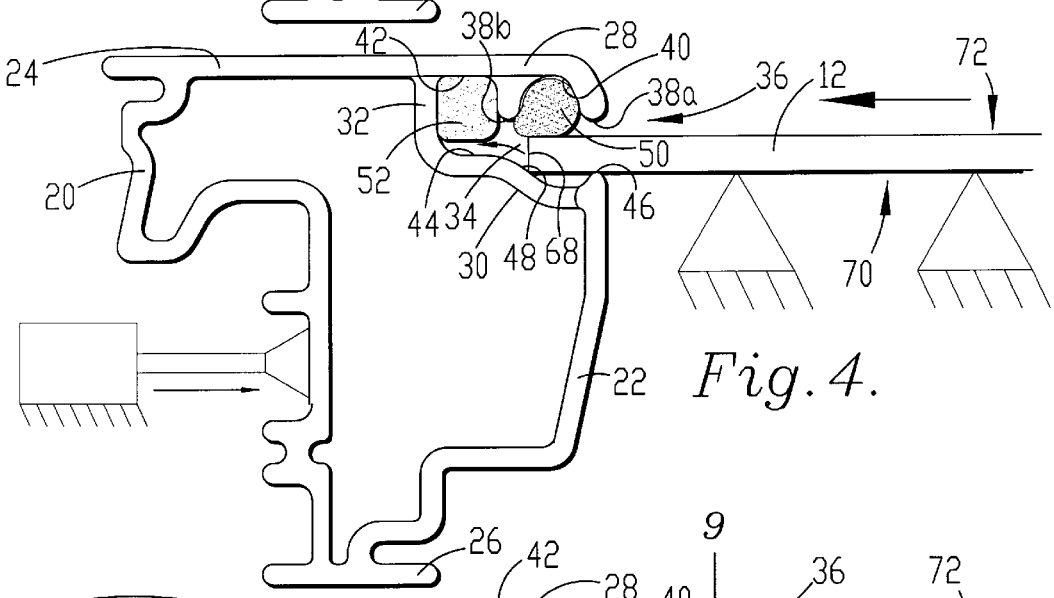
FIG. 4 is a sectional view of one of the frame members of FIG. 1 in relation to a pane illustrating an intermediate step in the manufacture of the preferred apparatus.
Figure 5:
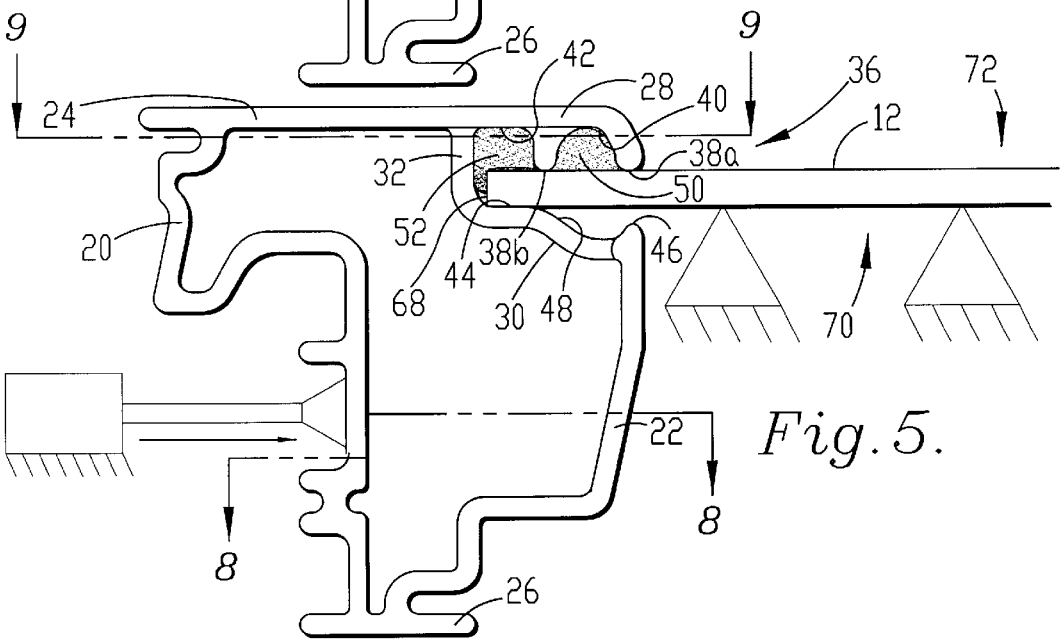
FIG. 5 is a sectional view of one of the frame members of FIG. 1 in relation to a pane illustrating a subsequent step in the manufacture of the preferred apparatus.

As illustrated by the cross sections in FIGS. 3–5, each frame member 16 includes outboard wall 20 and inboard wall 22 interconnected by upper wall 24 and lower wall 26. Frame member 16 also includes first cavity wall 28, second cavity wall 30 and stop wall 32 cooperatively defining pane-receiving cavity 34 having cavity opening 36 defined through inboard wall 22.

First wall 28 includes a pair of spaced, pane-supporting ridges 38*a* and 38*b* defining a first, sealant-receiving trough 40 therebetween. Ridge 38*b* and stop wall 32 define a second, sealant-receiving trough 42 therebetween.

Second wall 30 includes pane-supporting shelf 44 adjacent stop wall 32 and spaced from ridges 38*a,b* by the thickness of pane 12 for supporting pane 12 therebetween. Second wall 30 also includes entrance ridge 46 opposite ridge 38*a* and defining cavity opening 36 therebetween and further includes ramp 48 positioned between shelf 44 and entrance ridge 46. The width of cavity opening 36 is greater than the thickness of pane 12 and ramp 48 provides for gradual narrowing of cavity 34 from opening 36 toward shelf 44.

In the preferred embodiment, first trough 40 includes a bead 50 of silicone sealant therein which is preferred for its ability to seal and adhere to both pane 12 and frame members 16. Second trough 42 preferably includes a strip 52 of butyl for use in initially centering pane 12 to frame member 16 as discussed further herein.

Each corner coupler 18 includes a central body 54, a pair of axial alignment blocks 56*a* and 56*b* positioned at right angles to one another, and a pair of spaced, parallel transverse alignment blocks 58*a* and 58*b*. Each coupler 18 also includes a central sealant channel 60, a pair of fill holes 62 defined respectively through blocks 56*a,b* and in communication with channel 60, and sealant space 64 above central body 54 and between blocks 58*a,b*. The profiles of frame members 16 are configured to receive blocks 56*a,b* and 58*a,b* in order to align the corners as illustrated in FIGS. 3–9. Outboard wall 20 of each frame member 16 also includes a pair of seal ports 66 adjacent each end thereof and positioned for registration with fill holes 62 when apparatus 10 is assembled.

FIGS. 2–5 illustrate the assembly process for apparatus 10. In preparation, butyl strip 52 would be placed in second trough 42 of each member 16. It will be appreciated that butyl strip 52 need not be continuous in that an intermittent strip may be sufficient for centering pane 12. Next, silicone bead 50 would be applied to trough 40 of each frame member 16*a–d* using conventional techniques. At this stage, the silicone is flowable. In addition, corner couplers 18*a* and 18*b* would be inserted into opposed ends of frame member 16*a* and secured in place by screws through respective seal ports 66 threaded into fill holes 62. Similarly, corner couplers 18*c* and 18*d* would be secured in frame member 16*c* on the opposite side of pane 12.

Pane 12 would be placed in the horizontal position on support blocks and frame members 16*a–d* would be positioned as illustrated in FIG. 2 about pane 12 and spaced from pane edge 68. As illustrated in FIG. 3, pane 12 would be positioned relative to frame member 16 so that pane lower face 70 just clears entrance ridge 46 with space between pane upper face 72 and support ridge 38*a*. Frame members 16 would be held in this position by clamps operated by air or hydraulic cylinders for moving frame members 16 inwardly toward pane 12.

With the preparatory steps complete, frame members 16 would be shifted toward pane 12. As this movement progresses, pane 12 would enter cavity opening 36 of each member 16 with pane lower face 70 just clearing entrance ridge 46, as illustrated in FIG. 3, and with space between pane upper face 72 and support ridge 38*a*.

Referring to FIG. 4, as frame members 16 continue shifting toward one another, pane upper face 72 comes into contact with silicone bead 50, and pane edge 68 engages ramp 48. With continued shifting, pane edge 68 follows the contour of ramp 48 and lifts from its support blocks. This action presents two components of the movement of pane 12 relative to each frame member 16 as viewed in FIGS. 3–5: upwardly toward ridges 38*a,b* and leftwardly toward stop wall 32. During this movement, silicone from bead 50 begins to smear on pane upper face 72. The leftward movement carries the excess silicone along pane upper face 72 and prevents the excess from escaping beyond support ridge 38*a*.

Also, pane edge 68 comes into contact with butyl strip 52 which begins to deform. Butyl strip 52 is used for centering frame members 16 and pane 12. Silicone is preferred as providing a high quality seal and adherence, but these properties are not presented until the silicone sets.

The relative movement between frame members 16 continues until pane 12 is seated with lower face 70 on shelf 44 and pane upper face 72 engaging support ridge 38*a,b*, as illustrated in FIG. 5. In this position, pane edge 68 is adjacent stop wall 32 with butyl strip 52 holding pane 12 against shelf 44. Also in this position, silicone bead 50 engages pane upper face 72 and when set, provides strong adherence between frame members 16 and pane 12 and provides a weather tight seal.

As the four frame members 16*a-d* come together, the leading edges of the exposed axial alignment blocks 56 extending from members 16*a* and 16*c* enter the respective ends of members 16*b* and 16*d*. Blocks 56 aid in aligning and guiding members 16 into the assembled position shown in FIGS. 1 and 8–9.

In the assembled position, seal ports 66 of members 16*b* and 16*d* are in registration with fill holes 62 of corresponding alignment blocks 56, as illustrated in FIGS. 8–9. Silicone would then be injected through seal ports 66. The injected silicone would travel through fill holes 62, up through sealant channel 60 and into sealant space 64. The silicone in space 64 comes into contact with the ends of adjacent silicone beads 50 in troughs 40. This ensures a continuous silicone seal between pane 12 and frame 14. Additionally, sealant space 64 overlaps the lower side of the mitered joint between adjacent frame members 16. The injection of silicone into space 64 ensures that this joint is sealed. After the injection of silicone, screws are inserted through seal ports 66 and into fill holes 62. This holds the corners tight until the silicone sets.

As those skilled in the art will appreciate, the present invention improves many variations in the preferred embodiment described herein. For example, materials other than silicone and butyl are available for sealing. Additionally, other techniques can be used for producing the relative movement between the frame members and the pane and other assembly sequences can be used.

Having thus described the preferred embodiment of the present invention, the following is claimed as new and desired to be secured by Letters Patent:

1. A fenestration apparatus for use with a pane comprising:

an outboard wall;

an inboard wall coupled with said outboard wall and spaced therefrom; and structure including a first wall and a second wall spaced from said first wall and defining a cavity therebetween having an opening in said inboard wall, said cavity being configured for receiving a pane therein through said opening, said outboard wall, inboard wall and structure cooperatively defining an integral fenestration member, said first wall including a pane-engaging surface, said second wall including a shelf spaced from said surface and configured for engaging and holding a pane therebetween, and a ramp between said shelf and said opening providing a gradually narrowing of said cavity from said opening toward said shelf.

2. The apparatus as set forth in claim 1 being composed of synthetic resin material.

3. The apparatus as set forth in claim 1, said pane engaging surface including a pair of spaced ridges.

4. The apparatus as set forth in claim 3, said spaced ridges defining a sealant-receiving trough therebetween.

5. The apparatus as set forth in claim 4, said cavity terminating in a stop wall, said ridges including an inboard ridge, said stop wall and inboard ridge defining a second, sealant-receiving trough therebetween.

6. The apparatus as set forth in claim 1, said cavity terminating in a stop wall.

7. A fenestration apparatus comprising:

a pane; and a plurality of frame members enclosing said pane, each of said members including an outboard wall, an inboard wall coupled with said outboard wall and spaced therefrom, and structure including a first wall and a second wall spaced from said first wall and defining a cavity therebetween having an opening in said inboard wall, said cavity receiving said pane therein through said opening, said opening presenting a width greater than the thickness of said pane, said outboard wall, inboard wall, and structure defining an integral fenestration member, said first wall including a pane-engaging surface, said second wall including a shelf spaced from said surface by the thickness of said pane, and engaging and holding said pane therebetween, and a ramp between said shelf and said opening providing a gradual narrowing of said cavity from said opening toward said shelf.

8. The apparatus as set forth in claim 7, said frame members being composed of synthetic resin material.

9. The apparatus as set forth in claim 7, said pane engaging surface including a pair of spaced ridges.

10. The apparatus as set forth in claim 9, said spaced ridges defining a sealant-receiving trough therebetween.

11. The apparatus as set forth in claim 10, said cavity terminating in a stop wall, said ridges including an inboard ridge, said stop wall and inboard ridge defining a second, sealant-receiving trough therebetween.

12. The apparatus as set forth in claim 7, said cavity terminating in a stop wall.

13. The apparatus as set forth in claim 7, each of said members being integrally formed by extrusion and composed of pultrusion.

14. The apparatus as set forth in claim 7, said pane-engaging surface including trough means defining a sealant-receiving trough therebetween with said trough including a bead of sealant therein and engaging said pane.

15. The apparatus as set forth in claim 14, said sealant including silicone.

16. The apparatus as set forth in claim 15, said trough means including a pair of spaced ridges defining said trough therebetween.

17. The apparatus as set forth in claim 7, said cavity terminating in a stop wall, said pane-engaging surface and said stop wall defining a trough therebetween with sealant received in said trough.

18. The apparatus as set forth in claim 17, said sealant including butyl.

19. The apparatus as set forth in claim 7, said structure including trough means defining a sealant-receiving trough with sealant therein sealing between said frame members and pane.

20. The apparatus as set forth in claim 19, said trough means defining first and second sealant-receiving troughs with sealant contained in each of said troughs and sealing between said frame members and pane.

21. The apparatus as set forth in claim 20, said pane-engaging surface including a pair of ridges defining said first trough therebetween, said cavity terminating a stop wall, said ridges including an outboard ridge, said stop wall and outboard ridge defining said second trough.

22. The apparatus as set forth in claim 21, said first trough including silicone sealant and said second trough including butyl sealant.

23. The apparatus as set forth in claim 7, said frame members abutting one another at joints, said apparatus further including a plurality of joint couplers received within adjacent frame members and coupling and aligning adjacent frame members.

24. A fenestration apparatus comprising:

a pane; and a plurality of frame members enclosing said pane, each of said members including outboard wall, an inboard wall coupled with said outboard wall and spaced therefrom, and structure including a first wall and a second wall spaced from said first wall and defining a cavity therebetween having an opening in said inboard wall, said cavity receiving said pane therein through said opening, said opening presenting a width greater than the thickness of said pane, said first wall including a pane-engaging surface, said second wall including a shelf spaced from said surface by the thickness of said pane and holding said pane therebetween, and a ramp between said shelf and said opening providing a gradual narrowing of said cavity from said opening toward said shelf, said frame members abutting one another at joints, said apparatus further including a plurality of joint couplers received within adjacent frame members and coupling an aligning adjacent frame members, each of said joint couplers including sealant-receiving passages therein containing sealant for sealing said joints.

25. A fenestration apparatus comprising:

a pane; and a plurality of frame members enclosing said pane, each of said members including an outboard wall, an inboard wall coupled with said outboard wall and spaced therefrom, and structure including a first wall and a second wall spaced from said first wall and defining a cavity therebetween having an opening in said inboard wall, said cavity receiving said pane therein through said opening, said opening presenting a width greater than the thickness of said pane, said first wall including a pane-engaging surface, said second wall including a shelf spaced from said surface by the thickness of said pane and holding said pane therebetween, and a ramp between said shelf and said opening providing a gradual narrowing of said cavity from said opening toward said shelf, said frame members abutting one another at joints, said apparatus further including a plurality of joint couplers received within adjacent frame members and coupling an aligning adjacent frame members, each of said frame members including trough means defining respective sealant-receiving troughs with sealant received therein and engaging said frame members and pane, each of said joint couplers including sealant-receiving passages therein containing sealant for sealing said joints, said passages being in communication with said troughs thereby presenting continuous sealant between said frame members and pane.

26. The apparatus as set forth in claim 25, said sealant including silicone.

27. A fenestration apparatus produced by the method comprising the steps of:

(a) placing a plurality of frame members about a pane presenting a circumscribing edge, each of said frame members being integrally formed and including an outboard wall;

an inboard wall; and structure including a first wall and a second wall spaced from said first wall and defining a cavity therebetween having an opening in said inboard wall, said cavity being receiving said pane therein through said opening, said opening presenting a width greater than the thickness of said pane, said first wall including a pane-engaging surface, said second wall including a shelf spaced from said surface by the thickness of said pane, and engaging and holding said pane therebetween, and a ramp between said shelf and said opening providing a gradual narrowing of said cavity from said opening toward said shelf, each of said frame members presenting respective frame ends abutting one another in surrounding relationship relative to said pane;

(b) shifting said frame members and pane toward one another so that, for each of said frame members, said pane edge enters said opening and engages said ramp and continuing said shifting so that said edge follows the contour of said ramp until said pane engages said shelf and said surface with said pane held therebetween and until said frame ends abut one another in a surrounding relationship relative to said pane; and (c) securing said frame members and said pane in said surrounding relationship thereby forming said apparatus.

28. The apparatus as set forth in claim 27 wherein step (a) includes the steps of using frame members presenting an integral construction as said frame members, placing joint couplers between frame ends of adjacent ones of said frame members with said joint couplers aligning said frame members with one another, said pane-engaging surface including a pair of ridges defining a sealant-receiving trough therebetween, placing sealant in said trough, said joint couplers including sealant-receiving passages configured for fluid communication with said trough, said method including, after step (b), the step of placing sealant in said passages and into contact with sealant in said trough in order to form a continuous seal between said frame members and said pane.

* * * * *